US011395090B2

(12) United States Patent
Giurda

(10) Patent No.: US 11,395,090 B2
(45) Date of Patent: Jul. 19, 2022

(54) ESTIMATING A DIRECT-TO-REVERBERANT RATIO OF A SOUND SIGNAL

(71) Applicants: Universität Zürich, Zurich (CH); SONOVA AG, Staefa (CH)

(72) Inventor: Ruksana Giurda, Zurich (CH)

(73) Assignees: Universität Zürich, Zurich (CH); Sonova AG, Staefa (CH)

( * ) Notice: Subject to any disclaimer, the term of this patent is extended or adjusted under 35 U.S.C. 154(b) by 0 days.

(21) Appl. No.: 17/167,931

(22) Filed: Feb. 4, 2021

(65) Prior Publication Data

US 2021/0250722 A1 Aug. 12, 2021

(30) Foreign Application Priority Data

Feb. 6, 2020 (EP) ..... 20155833

(51) Int. Cl.
*H04S 7/00* (2006.01)
*H04R 3/00* (2006.01)
*G10L 21/0208* (2013.01)

(52) U.S. Cl.
CPC ..... *H04S 7/305* (2013.01); *H04R 3/005* (2013.01); *G10L 21/0208* (2013.01); *G10L 2021/02082* (2013.01)

(58) Field of Classification Search
USPC ..... 381/17, 18, 63, 66, 150
See application file for complete search history.

(56) References Cited

U.S. PATENT DOCUMENTS

| | | | |
|---|---|---|---|
| 8,160,262 | B2 | 4/2012 | Buck et al. |
| 9,538,297 | B2 | 1/2017 | Hazrati et al. |
| 9,549,266 | B2 | 1/2017 | Feilner et al. |

(Continued)

FOREIGN PATENT DOCUMENTS

| | | | | |
|---|---|---|---|---|
| EP | 2916321 | | 10/2017 | |
| WO | 2014138134 | | 9/2014 | |
| WO | WO 2014/138134 | * | 9/2014 | ..... G10K 11/34 |

OTHER PUBLICATIONS

Extended European Search Report received in EP Application No. 20155833.5 dated Aug. 7, 2020.

(Continued)

*Primary Examiner* — Yosef K Laekemariam
(74) *Attorney, Agent, or Firm* — ALG Intellectual Property, LLC

(57) ABSTRACT

An illustrative method for estimating a direct-to-reverberant ratio of a sound signal is described, wherein the direct-to-reverberant ratio is indicative of a ratio between direct sound received from a sound source and reverberated sound received from reflections in an environment of the sound source. The method includes determining a first energy value of a sound signal for a first time frame; assigning to an onset value of the first time frame a positive value, if the difference of the first energy value of the first time frame and a second energy value of a preceding second time frame is greater than a threshold, and a zero value otherwise; and determining the direct-to-reverberant ratio by providing an onset signal comprising the onset value to a machine learning algorithm, which has been trained to determine the direct-to-reverberant ratio based on the onset signal.

20 Claims, 4 Drawing Sheets

(56) References Cited

U.S. PATENT DOCUMENTS

| | | | | |
|---|---|---|---|---|
| 9,997,170 | B2 | 6/2018 | Gannot et al. | |
| 2008/0189107 | A1* | 8/2008 | Laugesen | G10L 21/02 381/63 |
| 2015/0149160 | A1 | 5/2015 | Lou et al. | |
| 2017/0303053 | A1 | 10/2017 | Falch et al. | |
| 2018/0041835 | A1 | 2/2018 | Sun | |
| 2019/0394579 | A1 | 12/2019 | Rosenkranz et al. | |

OTHER PUBLICATIONS

Eaton, et al., "Direct-to-Reverberant Ratio Estimation Using a Null-Steered Beamformer," ICASSP, 2015 IEEE.

Lu, et al., "Binaural Estimation of Sound Source Distance via the Direct-to-Reverberant Energy Ratio for Static and Moving Sources," IEEE Transactions on Audio, Speech, and Language Processing, vol. 18, No. 7, Sep. 2010.

Thiergart, et al., "Signal-to-Reverberant Ratio Estimation Based on the Complex Spatial Coherence Between Omnidirectional Microphones," ICASSP; 978-1-4673-0046-9/12, 2012 IEEE.

Zahorik, "Direct-to-Reverberant Energy Ratio Sensitivity," The Journal of the Acoustical Society of America 112, 2110 (2002); doi: 10.1121/1.1506692.

* cited by examiner

ESTIMATING A DIRECT-TO-REVERBERANT RATIO OF A SOUND SIGNAL

RELATED APPLICATIONS

The present application claims priority to EP Patent Application No. 20155833.5, filed Feb. 6, 2020, the contents of which are hereby incorporated by reference in their entirety.

BACKGROUND INFORMATION

Hearing devices are generally small and complex devices. Hearing devices can include a processor, microphone, speaker, memory, housing, and other electronical and mechanical components. Some example hearing devices are Behind-The-Ear (BTE), Receiver-In-Canal (RIC), In-The-Ear (ITE), Completely-In-Canal (CIC), and Invisible-In-The-Canal (IIC) devices. A user can prefer one of these hearing devices compared to another device based on hearing loss, aesthetic preferences, lifestyle needs, and budget.

Daily sound acquired by a hearing device is constantly affected by reverberation. For a user of the hearing device, the reflected sound waves contribute to spatial perception and distance perception. For algorithms performed by the hearing device dealing with acoustic waves, a knowledge about the amount of reverberation present in the sound signal generated from the sound waves may be beneficial.

Several methods for direct-to-reverberant (energy) ratio (DRR) estimation have been proposed. However, these methods may have disadvantages, when used in hearing devices applications. Moreover, all the methods are based on assumptions about the sound field, which are not always met in reality. Some methods rely on the assumption of an isotropic sound field. Some methods require an a priori knowledge of the direction of arrival with respect to the sound source. In all these cases, at least more than one microphone is used.

US 20170303053 A1 relates to a hearing device, in which a dereverberation process is performed that measures a dedicated reverberation reference signal to determine reverberation characteristics of an acoustic environment, and reduces reverberation effects in the output signal of the hearing device based on the reverberation characteristics.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION

Figure 1:
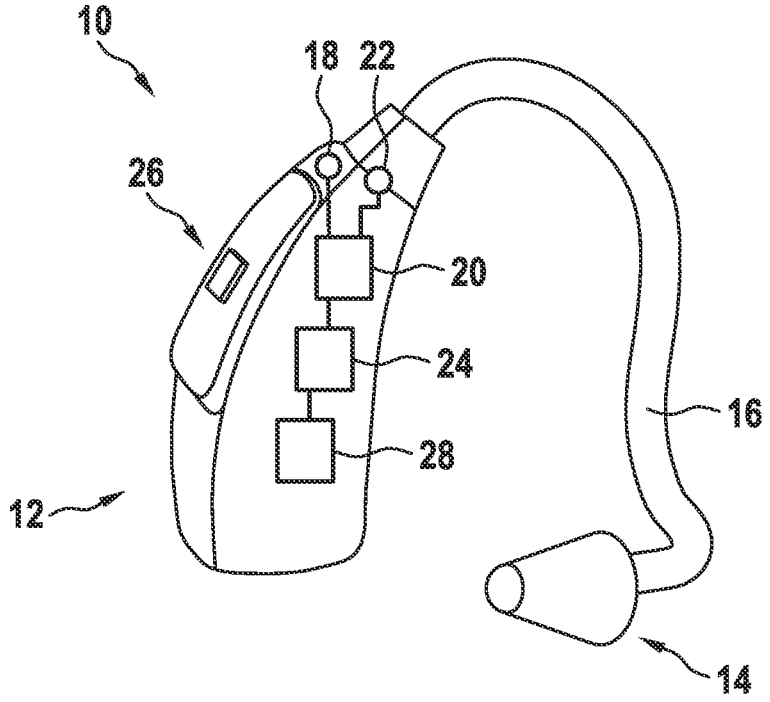
FIG. 1 schematically shows a hearing device according to an embodiment.

Described herein are a method, a computer program and a computer-readable medium for estimating a direct-to-reverberant ratio of a sound signal. Furthermore, the embodiments described herein relate to a hearing device.

Embodiments described herein provide a method for estimating a direct-to-reverberant ratio, which is suitable in hearing device applications. Further embodiments described herein provide a method for estimating a direct-to-reverberant ratio, which has low computational cost, is simple to implement, and can be performed with a sound signal recorded by solely one microphone.

These embodiments are achieved by the subject-matter of the independent claims. Further exemplary embodiments are evident from the dependent claims and the following description.

A first aspect relates to a method for estimating a direct-to-reverberant ratio of a sound signal. The method may be performed by a hearing device. The hearing device may comprise a microphone generating the sound signal. The hearing device may be worn by a user, for example behind the ear or in the ear. The hearing device may be a hearing aid for compensating a hearing loss of a user. Here and in the following, when to a hearing device is referred, also a pair of hearing devices, i.e. a hearing device for each ear of the user, may be meant. A hearing device may comprise a hearing aid and/or a cochlear implant.

The direct-to-reverberant ratio or more exact direct-to-reverberant energy ratio between direct sound received from a sound source and reverberated sound received from reflections in an environment of the sound source.

The direct sound may be based on sound waves travelling directly from one or more sound sources to a microphone acquiring the sound signal. The reflections and/or reverberated sound may be sound waves from the one or more sound sources, which are reflected in the environment. The direct-to-reverberant ratio may be number, for example between 0 and 1, where 0 may mean that no reverberated sound is present and/or 1 may mean that solely reverberated sound is present. The direct-to-reverberant ratio also may be provided in dB.

According to an embodiment, the method comprises: determining a first energy value of a sound signal for a first time frame. The sound signal may be determined into time frames. At least one energy value may be calculated from the sound signal for each time frame. The time frames all may have an equal length. It may be that the time frames are overlapping. The energy value may be indicative of the energy of the sound signal or at least of a frequency band of the sound signal in the respective time frame.

For example, the sound signal may be discretely Fourier transformed. In particular, the sound signal may be time-signal buffered with overlap, windowed, and Fourier transformed. Then a power per frame estimation may be performed. The sound signal may be divided into time frames and, in the time frames, the sound signal is transformed into frequency bins indicative of the strength of the sound signal in the frequency ranges associated with the frequency bins. From these strengths (i.e. Fourier coefficients), the energy values can be calculated.

According to an embodiment, the method further comprises: assigning to an onset value of the first time frame a positive value, if the difference of the first energy value of the first time frame and a second energy value of a preceding second time frame is greater than a threshold, and a zero value otherwise. At least one onset signal may be determined from the one or more energy values. An onset value of the onset signal for a time frame may be set to a positive value, when an energy value of the time frame is higher than an energy value of the preceding time frame for more than a threshold. The onset value is set to zero otherwise. An onset or more specific acoustic onset may be defined as a sudden jump of the energy of the sound signal, in particular a jump up.

An onset signal may comprise an onset value for each time frame. The positive value may be indicative of a presence of an onset and/or of the magnitude of the onset. For determining the onset and/or the onset value, the energy value of the time frame and of the previous time frame is compared. When the difference of the energy value of the time frame and the energy value of the previous time frame is higher for more than a threshold, then it is assumed that an onset is present.

The positive value, to which an onset value is set, may be 1, when an onset is detected for the time frame. In general, a positive value may be higher than a threshold as a zero value.

It also may be that the positive value, to which an onset value is set, is the difference of the energy value in the time frame and the energy value in the previous time frame, when an onset is detected for the time frame. When no onset is detected, the onset value may be set to 0.

In general, the method is based on the effect of reverberation on acoustic onsets. Reverberation usually may smear the spectrum of sound signals. Therefore, it may be assumed that the number and intensity of acoustic onsets decreases as reverberation increases.

It has to be noted that more than one energy value may be determined for each time frame with respect to different properties of the sound signal, such as different frequency bands. Then more than one onset signal, each for each property, may be determined.

According to an embodiment, the method further comprises: determining the direct-to-reverberant ratio by providing an onset signal comprising the onset value to a machine learning algorithm, which has been trained to determine the direct-to-reverberant ratio based on said onset signal. The direct-to-reverberant ratio may be determined by inputting the at least one onset signal and/or features derived thereof into a machine learning algorithm, which has been trained to produce a direct-to-reverberant ratio from the at least one onset signal.

The one or more onset signals may be input into a machine learning algorithm. It may be that the input sound signal is pre-processed before being input into the machine learning algorithm. For example, as described below, the onset signal may be integrated and/or a gradient of the integrated onset signal may be determined. The integrated onset signal and/or the gradient then may be input into the machine learning algorithm.

The machine learning algorithm has been trained to determine the direct-to-reverberant ratio based on the one or more onset signals. In general, the machine learning algorithm may have parameters, such as weights or coefficients, which have been adapted during the training, such that, when one or more onset signals and/or parameters derived thereof together with a known direct-to-reverberant ratio are input, this direct-to-reverberant ratio is output by the machine learning algorithm.

The method described herein, i.e. determining one or more onset signals from one single sound signal and determining the direct-to-reverberant ratio with a machine learning algorithm, is easy to implement and by choosing a suited machine learning algorithm, also computational less demanding. It has to be noted that rather simple machine learning algorithms, such as regression models, may be used.

By choosing appropriate positive values for the onset signals, the method may be independent of the level of the signal, i.e. does not depend on the loudness of the recordings. The method may be suitable for online and offline applications. The method is efficient in terms of memory and power required. The method may be used either monaurally either binaurally.

The method does not require previous knowledge of the orientation angle of the incoming sound. Furthermore, the method is not affected by a microphone directivity pattern.

According to an embodiment, the machine learning algorithm is trained with respect to a type of hearing device. It may be that the training data is recorded and generated for a specific type of hearing device with specific hardware, such as a casing and/or a microphone and/or a microphone position. It also may be that the machine learning algorithm is differently trained for a hearing device for the left ear and the right ear.

According to an embodiment, the onset signal is integrated over time, a gradient of the onset signal is determined and the gradient is provided to the machine learning algorithm. The one or more onset signals may be integrated and/or a gradient for each onset signal is determined. The integration may be performed for a time interval starting at a specific time point and ending at the time point for which the integrated onset value is determined. The gradient of each onset signal then may be input into the machine learning algorithm. As already mentioned, the one or more onset signals may be pre-processed before being input into the machine learning algorithm.

An onset signal may be integrated by summing up the energy values with respect to the timely ordered time frames. In other words, the value of the integrated onset signal for a time frame may be the sum of the energy values of all the energy values of the previous time frames.

The gradient of an integrated onset signal may be an average gradient of the integrated onset signal. Such an averaged gradient may be determined from gradients for at least some of the points defined by the integrated onset signal. Such an averaged gradient also may be determined by linear regression. In general, a gradient may be a number indicative of the raising of the corresponding onset signal.

According to an embodiment, the gradient for each onset signal is determined with a state space model. With a state space model, the gradient can be determined in a computational less demanding way, since it may be not necessary to invert matrices.

According to an embodiment, the machine learning algorithm is or at least comprises a linear regression model. The direct-to-reverberant ratio then may be determined from the gradients of the integrated onset signals. The gradients may be input into the linear regression model, which may comprise a linear functions weighting the gradients and producing the direct-to-reverberant ratio. The weights for the gradients may have been determined by training the machine learning algorithm.

It has to be noted that also other machine learning algorithms may be used. For example, the one or more onset signals may be input into an artificial neuronal network, which has been trained to classify the onset signals. The classifier output by the artificial neuronal network may be the direct-to-reverberant ratio or a range for the direct-to-reverberant ratio.

There are several possibilities, how properties of the sound signal are exploited to produce different energy values for each time frame. The overall energy of the sound signal may be used. It also may be that the energy of a frequency band of the sound signal is used. As further possibility, it may be that loud and/or quiet sounds are removed from the sound signal and that then, the energy values are determined from the sound signal with the loud and/or quiet sounds removed.

According to an embodiment, a broadband energy value is determined for the first or for each time frame, the broadband energy value being indicative of the energy of the sound signal in the time frame. For example, the broadband energy value may be determined from all frequencies bins in the time frame. The energy value of a frequency bin may be proportional to the square of the absolute value of the complex Fourier coefficient. These energy values all may be summed up.

According to an embodiment, a broadband onset signal is determined by setting a broadband onset value of the broadband onset signal for a time frame to a positive value, when the broadband energy value of the time frame is higher than the broadband energy value of the preceding time frame for more than a broadband threshold. From the broadband energy values a broadband onset signal may be determined. The positive value may be set to 0 and 1 as described above. It also may be that the positive value is set to a difference to the broadband energy value of the time frame and the broadband energy value of the previous time frame, when the criterion for onset in this time frame is met.

According to an embodiment, a frequency band energy value is determined for each time frame, the frequency band energy value being indicative of the energy of the sound signal in the frequency band in the time frame. Specific frequency bins may be assembled into a frequency band and the energy value for this frequency band may be determined solely from the Fourier coefficients of the associated frequency bins.

For example, the frequency band may have a lower bound, which is higher than a middle frequency of the complete spectrum available for the sound signal. Higher frequencies may be naturally more effected than lower frequencies, since sound diffraction based on reverberation occurs mostly in high frequency ranges.

According to an embodiment, a frequency band onset signal is determined by setting a frequency band onset value of the frequency band onset signal for a time frame to a positive value, when the frequency band energy value of the time frame is higher than the frequency band energy value of the preceding time frame for more than a frequency band threshold.

From the frequency band energy values a frequency band onset signal may be determined. The positive value may be set to 0 and 1 as described above. It also may be that the positive value is set to a difference to the frequency band energy value of the time frame and the frequency band energy value of the previous time frame, when the criterion for onset in this time frame is met.

According to an embodiment, the sound signal is divided into a plurality of frequency bands and a frequency band onset signal is determined for each frequency band. It may be that the frequency bands overlap. It also may be that the frequency bands cover the complete spectrum available for the sound signal.

According to an embodiment, a frequency band threshold is different from the broadband threshold. For example, the frequency band threshold is lower than the broadband threshold.

According to an embodiment, frequency band thresholds for different frequency bands are different. For example, a frequency band threshold for lower frequencies is lower than a frequency band threshold for higher frequencies.

According to an embodiment, a broadband onset signal and a plurality of frequency band onset signals, which may cover the frequency range available from the sound signal, are determined and are input into the machine learning algorithm. This may enhance the accuracy of the direct-to-reverberant ratio. The broadband onset signal may be determined with a positive value set to 1 and a plurality of frequency band onset signals for a plurality of frequency bands may be determined with a positive value set to 1.

It also may that different frequency band onset signals for the same frequency bands are determined, which are determined in different ways, for example with different types of positive values. A plurality of first frequency band onset signals for a plurality of frequency bands may be determined with a positive value set to 1. Furthermore, a plurality of second frequency band onset signals for the plurality of frequency bands may be determined with a positive value set to the difference of the energy value in the time frame and the energy value in the previous time frame.

The two previous embodiments may be combined, i.e. the broadband onset signal, the first frequency band onset signals and the second frequency band onset signals may be determined and input into the machine learning algorithm.

A further aspect relates to a method for operating a hearing device, the method comprising: generating a sound signal with a microphone of the hearing device; estimating a direct-to-reverberant ratio of the sound signal as described above and below; processing the sound signal for compensating a hearing loss of a user of the hearing device by using the direct-to-reverberant ratio; and outputting the processed sound signal to the user. The direct-to-reverberant ratio may be determined with a software module run in a processor of the hearing device. The processing of the sound signal may be performed with a sound processor of the hearing device, which may be tuned with the aid of the direct-to-reverberant ratio.

According to an embodiment, the direct-to-reverberant ratio is used in at least one of the following: noise cancelling, reverberation cancelling, frequency dependent amplification, frequency compressing, beam forming, sound classification, own voice detection, foreground/background classification. Each of these functions can be performed with a software module, such as a program of the hearing device. These software modules may use the direct-to-reverberant ratio as input parameter.

For example, a noise-cancelling algorithm may have a better estimation of a noise floor based on the direct-to-reverberant ratio. A reverberation-cancelling may profit for the same reason. The gain model, i.e. the frequency dependent amplification, and/or the compressor, i.e. frequency compressing, may be better tuned based on the amount of direct and reverberant energy, which can be determined from the direct-to-reverberant ratio. An adaptive beam former may have a better noise reference estimation based on direct-to-reverberant ratio. A sound classifier may be improved by also using the direct-to-reverberant ratio as additional input parameter. In particular, a program for "speech in reverb" may be optimized by additionally inputting the direct-to-reverberant ratio.

Further aspects described herein relate to a computer program for estimating a direct-to-reverberant ratio of a sound signal and optionally for operating a hearing device, which, when being executed by a processor, is adapted to carry out the steps of the method as described in the above and in the following as well as to a computer-readable medium, in which such a computer program is stored.

For example, the computer program may be executed in a processor of the hearing device, which hearing device, for example, may be carried by the person behind the ear. The computer-readable medium may be a memory of this hearing device.

In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

A further aspect relates to a hearing device adapted for performing the method as described in the above and the below. The hearing device may comprise a microphone, a sound processor, a processor and a sound output device. The method may be easily integrated in a hearing device, as it may exploit features which are already available in a DSP block and/or sound processor of the hearing device.

The microphone may be adapted for acquiring the sound signal. The sound processor, such as a DSP, may be adapted for processing the sound signal, for example for compensating a hearing loss of the user. The processor may be adapted for setting parameters of the sound processor based on the estimation of the direct-to-reverberant ratio. The sound output device, which is adapted for outputting the processed sound signal to the user, may be a loudspeaker or a cochlear implant.

It has to be understood that features of the method as described in the above and in the following may be features of the computer program, the computer-readable medium and the hearing device as described in the above and in the following, and vice versa.

These and other aspects will be apparent from and elucidated with reference to the embodiments described hereinafter.

FIG. 1 schematically shows a hearing device 10 in the form of a behind-the-ear device. It has to be noted that the hearing device 10 is a specific embodiment and that the method described herein also may be performed by other types of hearing devices, such as in-the-ear devices or hearables.

The hearing device 10 comprises a part 12 behind the ear and a part 14 to be put in the ear channel of a user. The part 12 and the part 14 are connected by a tube 16. In the part 12, a microphone 18, a sound processor 20 and a sound output device 22, such as a loudspeaker, are provided. The microphone 20 may acquire environmental sound of the user and may generate a sound signal, the sound processor 20 may amplify the sound signal and the sound output device 22 may generate sound that is guided through the tube 16 and the in-the-ear part 14 into the ear channel of the user.

The hearing device 10 may comprise a processor 24, which is adapted for adjusting parameters of the sound processor 20, such as a frequency dependent amplification, frequency shifting and frequency compression. These parameters may be determined by a computer program run in the processor 24. For example, with a knob 26 of the hearing device 12, a user may select a modifier (such as bass, treble, noise suppression, dynamic volume, etc.), which influences the functionality of the sound processor 20. All these functions may be implemented as computer programs stored in a memory 28 of the hearing device 10, which computer programs may be executed by the processor 24.

Figure 2:
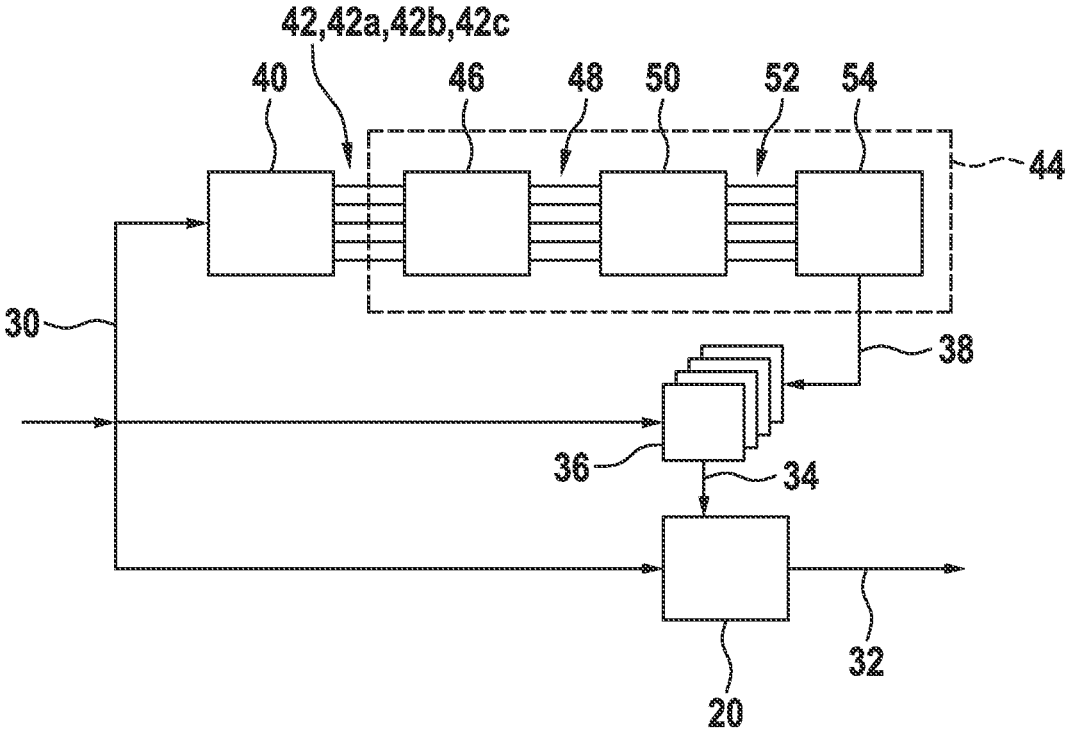
FIG. 2 shows a functional diagram of a hearing device illustrating a method for estimating a direct-to-reverberant ratio of a sound signal according to an embodiment.

FIG. 2 shows a functional diagram of a hearing device, such as the hearing device of FIG. 1. The blocks of the functional diagram may illustrate steps of the method as described herein and/or may illustrate modules of the hearing device 10, such as software modules that are run in the processor 24.

In the beginning a sound signal 30 is acquired by the microphone 18. For example, the sound signal may be recorded by the hearing device 10 at a sampling frequency of 22050 Hz. The sound signal 30 may be buffered in time frames of 128 samples with 75% overlap.

Figure 3:
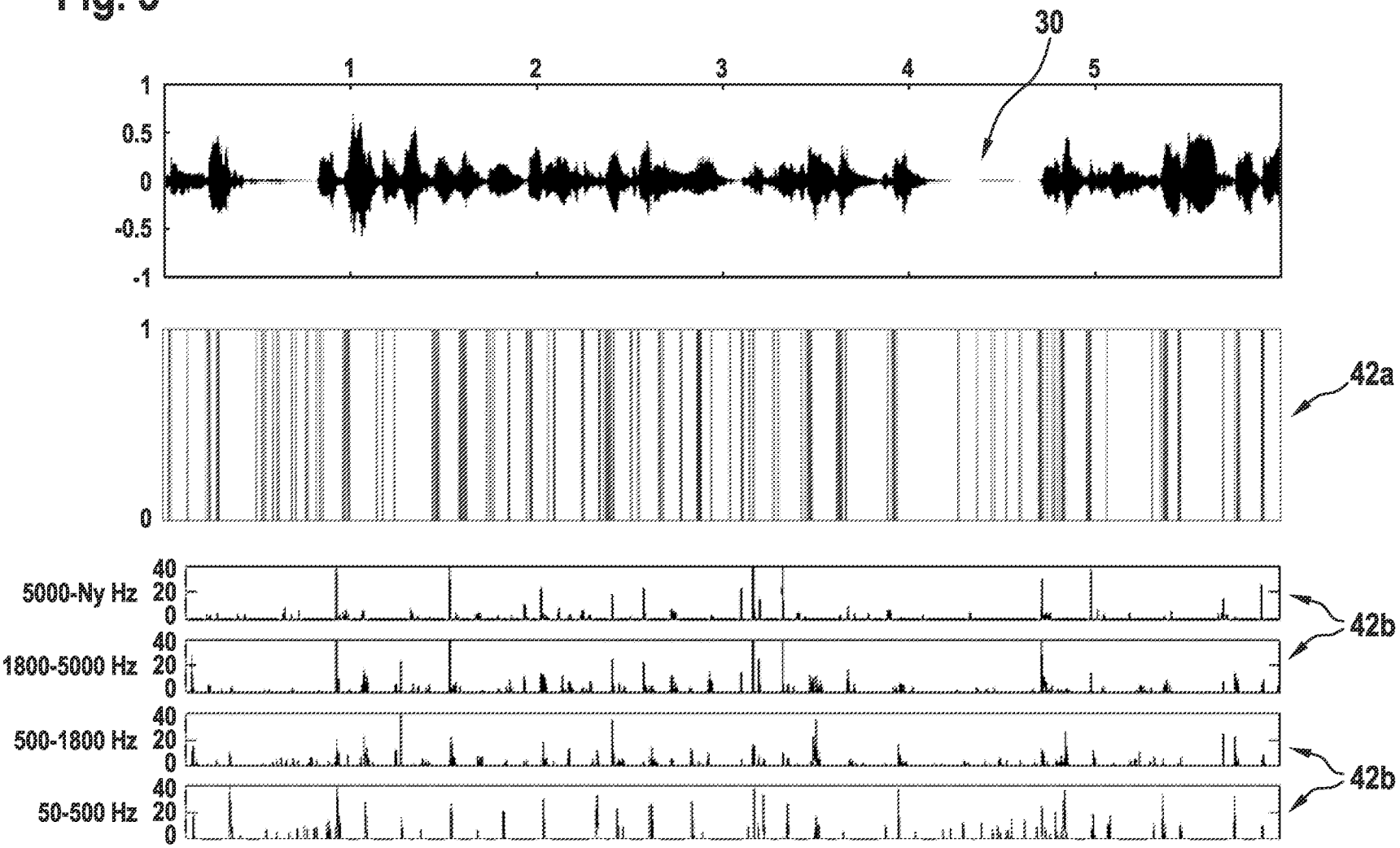
FIGS. 3 and 4 show diagrams with onset signals as produced in the method of FIG. 2.
Figure 4:
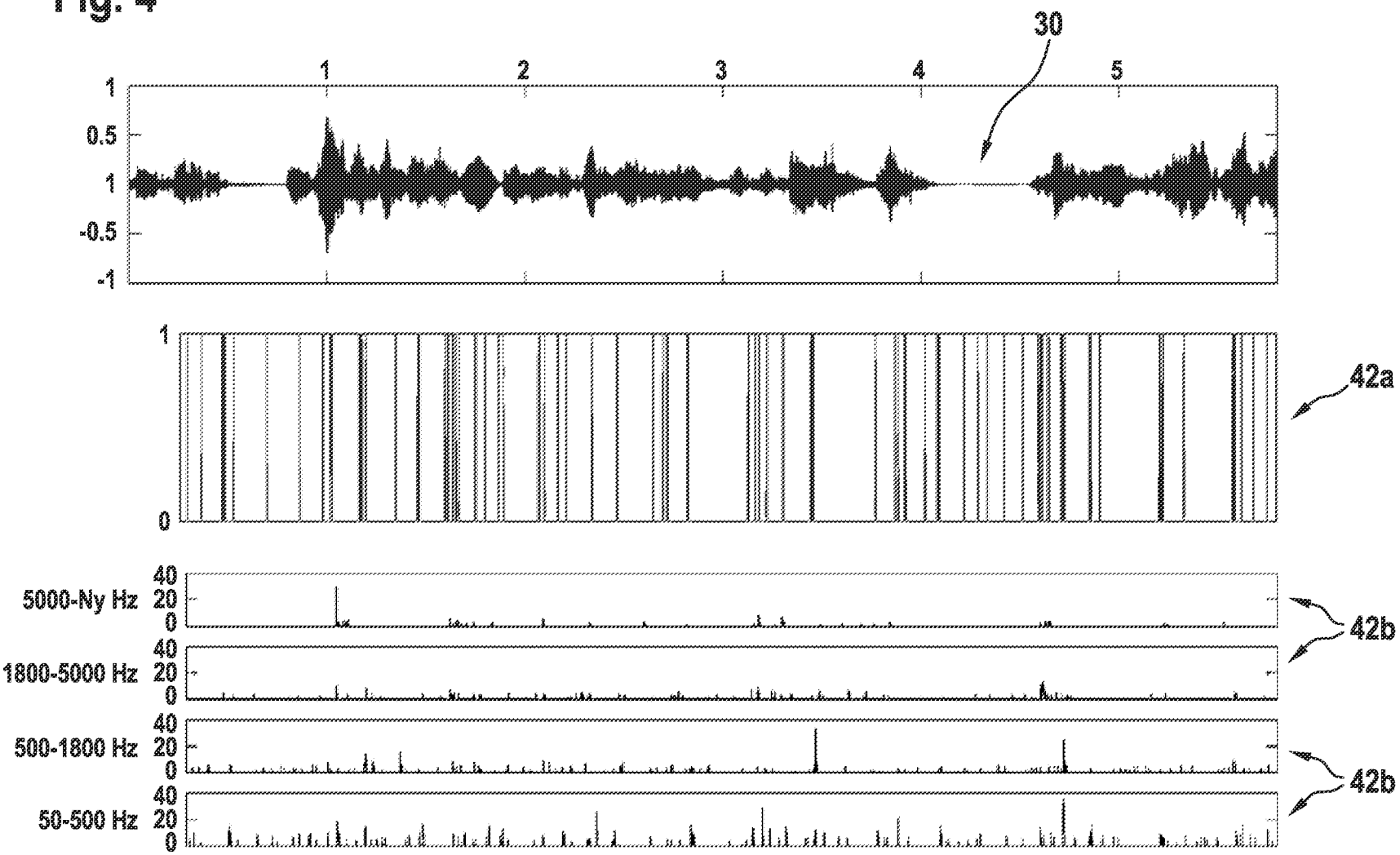

FIGS. 3 and 4 show a sound signal 30 in the form of a speech signal with a high direct-to-reverberant ratio (8.7 dB, FIG. 3) and with a low direct-to-reverberant ratio (−4.5 dB, FIG. 4). Both figures show the sound signal 30 in the time domain with respect to seconds.

The sound signal 30 and in particular the time frames then may be transformed from the time domain into the frequency domain by a discrete Fourier transform, such as a fast Fourier transformation. A Hanning window and/or zero padding may be applied before computing the discrete Fourier transform.

The sound signal 30 is processed by the sound processor 20 to produce an output sound signal 32, which then may be output by the loudspeaker 22, for example. The operation of the sound processor 20 can be adjusted with the aid of sound processor settings 34, which may be determined by programs 36 of the hearing device 10. These programs also may receive and evaluate the sound signal 30. For example, the programs 36 may perform noise cancelling, reverberation cancelling, frequency dependent amplification, frequency compressing, beam forming, sound classification, own voice detection, foreground/background classification, etc. by adjusting the sound processor 20 accordingly.

In particular, some or all of the programs 36 may receive a direct-to-reverberant ratio 38, which has been determined from the sound signal 30 and the programs 36 may additionally use this direct-to-reverberant ratio 38 to determine appropriate sound processor settings 34.

The direct-to-reverberant ratio 38 is determined in the following way.

In onset determination block 32, onset signals 42 are determined from the sound signal 30.

In general, the sound signal 30 may be divided into time frames, which may be done before the discrete Fourier transform and at least one energy value may be calculated from the sound signal 30 for each time frame. At least one onset signal 42 may be determined from the energy values, wherein an onset value of the onset signal 42 for a time frame is set to a positive value, when an energy value of the time frame is higher than an energy value of the preceding time frame for more than a threshold, and wherein the onset value is set to zero otherwise.

For example, for the sound signal 30 transformed into the frequency domain, the discrete Fourier transform bins may be grouped into a number of subbands based on the ERB (Equivalent Rectangular Bandwidth) scale. For example, there may be 20 of these subbands. The power in dB or equivalently energy then may be computed for each time frame and frequency subband $E_{k,f}$ (k indicates the number of the time frame and f the frequency band, for the broadband case the sub index f is not needed).

With this, the onset signals 42 can be computed.

FIGS. 3 and 4 show two different types of onset signals, a broadband onset signal 42*a* and frequency band onset signals 42*b*. The onset signals 42*a*, 42*b* of the respective figure correspond to the respective sound signal 30 in the top of the figure.

The broadband onset signal 42*a* is determined from the overall power and/or energy of the sound signal 30 in the time frames. If the difference between the broadband power and/or energy of a time frame k and a time frame k−1 exceeds a given threshold, then an onset is detected in frame k. The broadband onset 42*a* may be a binary feature, each time frame may take values 1 or 0. The value $0_k^{BB}$ at the k.th time frame of the broadband onset signal 42*a* may be determined according to $$O_k^{BB} = \begin{cases} 1, \text{ if } E_k - E_{k-1} \geq \text{threshold} \\ 0, \text{ otherwise} \end{cases}$$

Here, $E_k$ is the power and/or energy value of the k.th time frame calculated by summing up all $E_{k,f}$ from all subbands f.

A frequency band onset signal 42*b* is determined from the power and/or energy of the sound signal 30 in the time frames of a specific frequency band. A frequency band may be determined by aggregating several subbands. For example, the 20 subbands mentioned above may be grouped in 4 frequency bands. The table below shows how the frequency bands may be divided.

| Range label | Bands |
|---|---|
| Low | 1-7 |
| Mid-low | 8-12 |
| Mid-high | 13-17 |
| High | 18-20 |

It also may be that the frequency bins of the discrete Fourier transform are grouped into the frequency bands and that the power and/or energy for the frequency bands is directly calculated from the frequency bins. However, in many hearing devices, above mentioned subband energies are already determined for other reasons.

For a frequency band onset signal 42*c*, the computation rule for the value $0_k^i$ of the i.th frequency range at the k.th time frame may be $$O_k^i = \begin{cases} 1, \text{ if any } E_{k,f\in i} - E_{k,,f\in i-1} \geq \text{threshold} \\ 0, \text{ otherwise} \end{cases}$$

In FIGS. 3 and 4, not the frequency band onset signal 42*c* generated as binary signal (i.e. with solely having values 0 and 1) are shown, but frequency band onset signal 42*b*, where the value of the frequency band onset signal 42*b* is set to a strength of the onset, when an onset is detected.

The computation rule for the values $\tilde{0}_k^i$ of the Frequency band onset strength 42*b* may be nearly the same as for frequency band onset signal 42*c*. But in this case, whenever an onset is detected, the power and/or energy difference is used as value for that time frame.

$$\tilde{O}_k^i = \begin{cases} E_{k,i} - E_{k,i-1}, \text{ if any } E_{k,f\in i} - E_{k,,f\in i-1} \geq \text{threshold} \\ 0, \text{ otherwise} \end{cases}$$

It also may be that a broadband onset strength is determined in such a way.

It has to be noted that a frequency band threshold may not the same as the one for the broadband onset signal 42*a*. It also may be that the thresholds for different frequency band onset signal 42*b*, 42*c* may be different.

Higher frequency range are usually stronger affected as lower frequency ranges in terms of number of onsets. Thus, reverberation usually does not exclusively reduce the number of onsets, but changes also the onsets distribution over time. This directly can be seen from the onset signals 42*b* shown in FIGS. 3 and 4.

FIG. 3 and FIG. 4 also show the effect of reverberation on the frequency band onset strength. It can be seen that the overall strength is reduced with reverberation and that the highest frequency range is affected the most.

The onset signals 42 are then input into a machine learning algorithm 44. In general, the direct-to-reverberant ratio 38 may be determined by inputting at least one onset signal 42 into the machine learning algorithm 44, which has been trained to produce the direct-to-reverberant ratio 38 from the at least one onset signal 42.

The machine learning algorithm 44 may be composed of several subblocks. An integrator 46 may determine integrated onset signals 48. A gradient determiner 50 may determine a gradient 52 of each integrated onset signals 48 and the gradients 52 may be input into a regression model 54, which outputs the direct-to-reverberant ratio 38.

The integrator 46 calculates an integrated onset signal 48 from each onset signal 42 (and in particular from the onset signals 42*a*, 42*b*, 42*c*). This is done by cumulating the onset values of the respective onset signal 42 over time. The value of an integrated onset signal 48 for a time frame k may be the sum of the values of the onset signal 42 for the time frames 0 to k.

Figure 5:
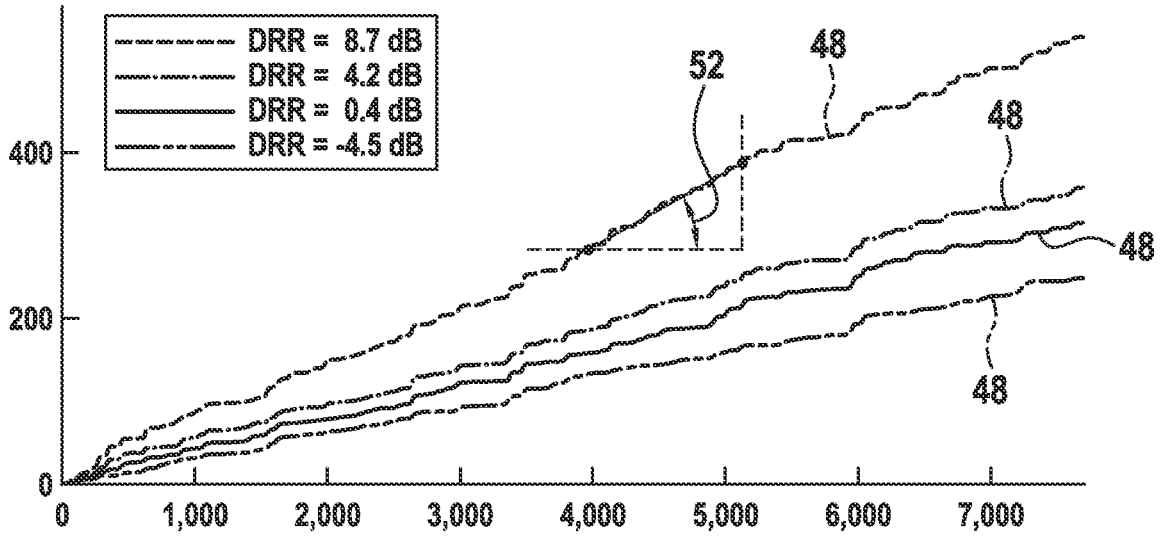
FIG. 5 shows a diagram with integrated onset signals as produced in the method of FIG. 2.

FIG. 5 shows an example with curves for several integrated onset signals 52 for the same type of onset signal 42, such as a broadband onset signal 42*a* or a frequency band onset signal 42*a*, 42*b*. In the diagram the number of time frames is depicted to the right. The curves have been determined for different known direct-to-reverberant ratio 38, DRR. It can be seen that when the direct-to-reverberant ratio 38 is higher, also the overall gradient and/or gradient 52 of the integrated onset signals 52 is higher.

The integrated onset signals 48 are input into the gradient determiner 50, which determines a gradient 52 for each integrated onset signals 48. In particular, there is a gradient 52 associated with each onset signal 42*a*, 42*b*, 42*c*.

The one or more gradients 52 can be determined by calculating a mean gradient of the respective integrated onset signals 48. This may be done by determining gradients of remote points of the curves, as indicated in FIG. 5. These gradients may be averaged.

It also is possible to determine a gradient 52 of the curve by using a state space model. With a state space model it is possible to calculate the gradient in a less demanding computational way, since a high number of divisions and/or inverting of large matrices can be avoided. The state space model may perform a local line fit on the accumulated onset. As a line is fully described by its gradient and its intercept, the parameters of the fit may directly represent those quantities. The intercept may be discarded and the gradient may be kept. The state space model may be represented by a 2×2-matrix. An inversion to get the gradient can be avoided by using a pseudoinverse matrix.

The one or more gradients 52 are then input into the linear regression model 54 and/or are used as features for the linear regression model 54. As described above, it can be assumed that the gradients 52 are indicative of a reverberation in the respective frequency band associated with the onset signal 42, 42*a*, 42*b*, 42*c* and additionally react differently to a change in reverberation for different frequency bands. Thus, the gradients 52 are good features for a machine learning algorithm.

The linear regression model 54 has been trained with gradients 52 extracted from sound signals 30 having different known direct-to-reverberant ratios 38. The output of the linear regression model 54 is the estimation of the direct-to-reverberant ratio 38.

The linear regression model 54 may have a weight and/or coefficient for each gradient 52, which is input into it. The output of the linear regression model 54, i.e. the estimated direct-to-reverberant ratio 38, is the sum of these weights and/or coefficients multiplied with the respective gradient 52. These weights and/or coefficients are the parameters, which are adjusted during training.

It as to be noted that the one or more onset signals 42 and/or the gradients 52 may be input into another type of machine learning algorithm, such as an artificial neuronal network.

Figure 6:
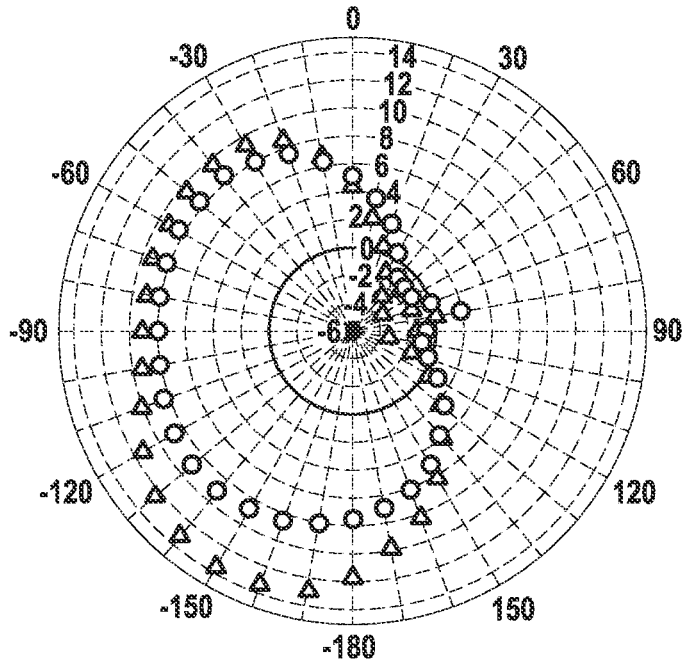
FIG. 6 shows a diagram illustrating the performance of the method of FIG. 2.

FIG. 6 shows a diagram indicating the performance of the direct-to-reverberant ratio estimator 40, 44 as a function of the azimuth angle of the sound source. In particular, the performance of the direct-to-reverberant ratio estimator for 36 direction of arrival of the sound. It needs to be remarked that the estimator has no knowledge of the direction of arrival of the sound. The values labelled with circles refer to a direct-to-reverberant ratio estimation obtained from the front-left microphone in a behind-the ear hearing device with the method as described herein.

The values labelled with triangles refer to a direct-to-reverberant ratio computed from the room impulse responses recorded through the front-left microphone and further measurements in the room. The values labelled with triangles are affected by a directivity pattern of the hearing device for the left-rear azimuths and the contralateral values are affected by a head shadow. However, on the ipsilateral side, the same direct-to-reverberant ratio should be determined. It can be seen that the estimations are not affected by the directivity pattern in the left-rear side.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 hearing device
12 part behind the ear
14 part 14 in the ear
16 tube
18 microphone
20 sound processor
22 sound output device
24 processor
26 knob
28 memory
30 sound signal
32 output sound signal
34 sound processor settings
36 hearing device program
38 direct-to-reverberant ratio
40 onset signal determination
42 onset signal
42*a* broadband onset signal
42*b* frequency band onset signal
42*c* frequency band onset signal
44 machine learning algorithm
46 integrator
48 integrated onset signal
50 gradient determiner
52 gradient
54 regression model

What is claimed is:

1. A method for estimating a direct-to-reverberant ratio of a sound signal, wherein the direct-to-reverberant ratio is indicative of a ratio between direct sound received from a sound source and reverberated sound received from reflections in an environment of the sound source, the method comprising:

determining a first energy value of a sound signal for a first time frame;

assigning to an onset value of the first time frame a positive value, if a difference of the first energy value of the first time frame and a second energy value of a preceding second time frame is greater than a threshold, and a zero value otherwise; and determining the direct-to-reverberant ratio by providing an onset signal comprising the onset value to a machine learning algorithm, which has been trained to determine the direct-to-reverberant ratio based on the onset signal.

2. The method of claim 1, wherein the onset signal is integrated over time, a gradient of the onset signal is determined and the gradient is provided to the machine learning algorithm.

3. The method of claim 2, wherein the gradient for the integrated onset signal is determined by means of a state space model.

4. The method of claim 1, wherein the machine learning algorithm comprises a linear regression model.

5. The method of claim 1, wherein a broadband energy value is determined for the first time frame, the broadband energy value being indicative of the energy of the sound signal in the first time frame; and wherein a broadband onset signal is determined by setting a broadband onset value of the broadband onset signal for the first time frame to a positive value, when the broadband energy value of the first time frame is higher than the broadband energy value of the preceding second time frame for more than a broadband threshold.

6. The method of claim 5, wherein a frequency band energy value is determined for the first time frame, the frequency band energy value being indicative of the energy of the sound signal in the frequency band in the first time frame; and wherein a frequency band onset signal is determined by setting a frequency band onset value of the frequency band onset signal for the first time frame to a positive value, when the frequency band energy value of the first time frame is higher than the frequency band energy value of the preceding second time frame for more than a frequency band threshold.

7. The method of claim 6, wherein the sound signal is divided into a plurality of frequency bands and a frequency band onset signal is determined for each frequency band.

8. The method of claim 6, wherein the frequency band threshold is different from the broadband threshold; and/or wherein frequency band thresholds for different frequency bands are different.

9. The method of claim 1, wherein the positive value, to which an onset value is set, is 1; or wherein the positive value is the difference of the energy value in the first time frame and the energy value in the preceding second time frame.

10. The method of claim 1, wherein a broadband onset signal is determined with a positive value set to 1;

wherein a plurality of first frequency band onset signals for a plurality of frequency bands are determined with a positive value set to 1;

wherein a plurality of second frequency band onset signals for the plurality of frequency bands are determined with a positive value set to the difference of the energy value in the first time frame and the energy value in the previous second time frame; and wherein the broadband onset signal, the first frequency band onset signals and the second frequency band onset signals are input into the machine learning algorithm.

11. The method of claim 1, wherein the method is performed by a hearing device, and the method further comprises:

generating, by the hearing device, the sound signal with a microphone of the hearing device;

processing, by the hearing device, the sound signal for compensating a hearing loss of a user of the hearing device using the direct-to-reverberant ratio; and outputting, by the hearing device, the processed sound signal to the user.

12. The method of claim 11, wherein the direct-to-reverberant ratio is used by the hearing device in at least one of the following:

noise cancelling, reverberation cancelling, frequency dependent amplification, frequency compressing, beam forming, sound classification, own voice detection, or foreground/background classification.

13. A non-transitory computer-readable medium storing a computer program for estimating a direct-to-reverberant ratio of a sound signal, which, when being executed by a processor, is adapted to carry out the steps of claim 1.

14. A hearing device, comprising:

a microphone configured to generate a sound signal; and a sound processor configured to estimate a direct-to-reverberant ratio of the sound signal, wherein the direct-to-reverberant ratio is indicative of a ratio between direct sound received from a sound source and reverberated sound received from reflections in an environment of the sound source, the estimating comprising determining a first energy value of the sound signal for a first time frame;

assigning to an onset value of the first time frame a positive value, if a difference of the first energy value of the first time frame and a second energy value of a preceding second time frame is greater than a threshold, and a zero value otherwise;

determining the direct-to-reverberant ratio by providing an onset signal comprising the onset value to a machine learning algorithm, which has been trained to determine the direct-to-reverberant ratio based on the onset signal.

15. The hearing device of claim 14, wherein the onset signal is integrated over time, a gradient of the onset signal is determined and the gradient is provided to the machine learning algorithm.

16. The hearing device of claim 15, wherein the gradient for the integrated onset signal is determined by means of a state space model.

17. The hearing device of claim 14, wherein the machine learning algorithm comprises a linear regression model.

18. The hearing device of claim 14, wherein a broadband energy value is determined for the first time frame, the broadband energy value being indicative of the energy of the sound signal in the first time frame; and wherein a broadband onset signal is determined by setting a broadband onset value of the broadband onset signal for the first time frame to a positive value, when the broadband energy value of the first time frame is higher than the broadband energy value of the preceding second time frame for more than a broadband threshold.

19. The hearing device of claim 14, wherein a frequency band energy value is determined for the first time frame, the frequency band energy value being indicative of the energy of the sound signal in the frequency band in the first time frame; and wherein a frequency band onset signal is determined by setting a frequency band onset value of the frequency band onset signal for the first time frame to a positive value, when the frequency band energy value of the first time frame is higher than the frequency band energy value of the preceding second time frame for more than a frequency band threshold.

20. The hearing device of claim 19, wherein the sound signal is divided into a plurality of frequency bands and a frequency band onset signal is determined for each frequency band.

* * * * *